US009913538B2

(12) United States Patent
Andreotti

(10) Patent No.: US 9,913,538 B2
(45) Date of Patent: Mar. 13, 2018

(54) SOFA SEAT CUSHION CORE

(71) Applicant: David Wayne Andreotti, Carlsbad, CA (US)

(72) Inventor: David Wayne Andreotti, Carlsbad, CA (US)

(73) Assignee: Jerome's Furniture, San Diego, CA (US)

( * ) Notice: Subject to any disclaimer, the term of this patent is extended or adjusted under 35 U.S.C. 154(b) by 43 days.

(21) Appl. No.: 15/017,182

(22) Filed: Feb. 5, 2016

(65) Prior Publication Data

US 2016/0235204 A1 Aug. 18, 2016

Related U.S. Application Data

(60) Provisional application No. 62/116,028, filed on Feb. 13, 2015.

(51) Int. Cl.

| | |
|---|---|
| ***A47C 7/20*** | (2006.01) |
| ***A47C 27/16*** | (2006.01) |
| ***A47C 27/15*** | (2006.01) |
| ***A47C 27/06*** | (2006.01) |
| ***A47C 27/045*** | (2006.01) |
| ***A47C 27/05*** | (2006.01) |
| ***A47C 7/34*** | (2006.01) |

(52) U.S. Cl.

CPC ..... *A47C 7/20* (2013.01); *A47C 7/34* (2013.01); *A47C 27/0456* (2013.01); *A47C 27/056* (2013.01); *A47C 27/064* (2013.01); *A47C 27/15* (2013.01); *A47C 27/16* (2013.01)

(58) Field of Classification Search

CPC ..... A47C 7/20; A47C 7/34; A47C 27/056; A47C 27/0456; A47C 27/064; A47C 27/15; A47C 27/16

USPC ..... 297/452.51, 452.5, 452.48

See application file for complete search history.

(56) References Cited

U.S. PATENT DOCUMENTS

| | | | | | |
|---|---|---|---|---|---|
| 1,476,456 | A * | 12/1923 | Meutsch | A47C 27/0456 | 5/654.1 |
| 2,536,310 | A * | 1/1951 | Reed | A47C 27/20 | 297/452.51 |
| 3,401,411 | A * | 9/1968 | Morrison | A47C 7/18 | 297/452.51 |
| 5,020,852 | A * | 6/1991 | Marion | B62J 1/00 | 297/200 |

(Continued)

*Primary Examiner* — Milton Nelson, Jr.

(74) *Attorney, Agent, or Firm* — Rutan & Tucker LLP; Hani Z. Sayed

(57) ABSTRACT

An apparatus and method are provided for a sofa seat cushion comprising a cushion core including a multiplicity of pocketed springs enclosed within an upholstery foam envelope. The pocketed springs are positioned side by side in a spring layer arrangement and are independently operable. A memory foam layer positioned above the upholstery foam envelope comprises a material capable of molding to a person's body sitting on the sofa seat cushion and then quickly returning to an original shape once the person leaves the sofa seat cushion. The memory foam layer comprises a gel-infused visco-elastic memory foam with a polyethylene terephthalate layer positioned there above. Directly below the upholstery foam envelope is an upholstery-grade polyurethane foam layer with a polyethylene terephthalate layer positioned directly thereunder. An exterior upholstery surrounding the cushion core provides a plush seating surface.

19 Claims, 1 Drawing Sheet

(56) References Cited

U.S. PATENT DOCUMENTS

| | | | | |
|---|---|---|---|---|
| 2004/0172767 | A1* | 9/2004 | Mossbeck | A47C 27/064 5/720 |
| 2005/0097676 | A1* | 5/2005 | Rensink | A47C 27/001 5/721 |
| 2015/0226278 | A1* | 8/2015 | Voros | A47C 23/0438 5/716 |

* cited by examiner

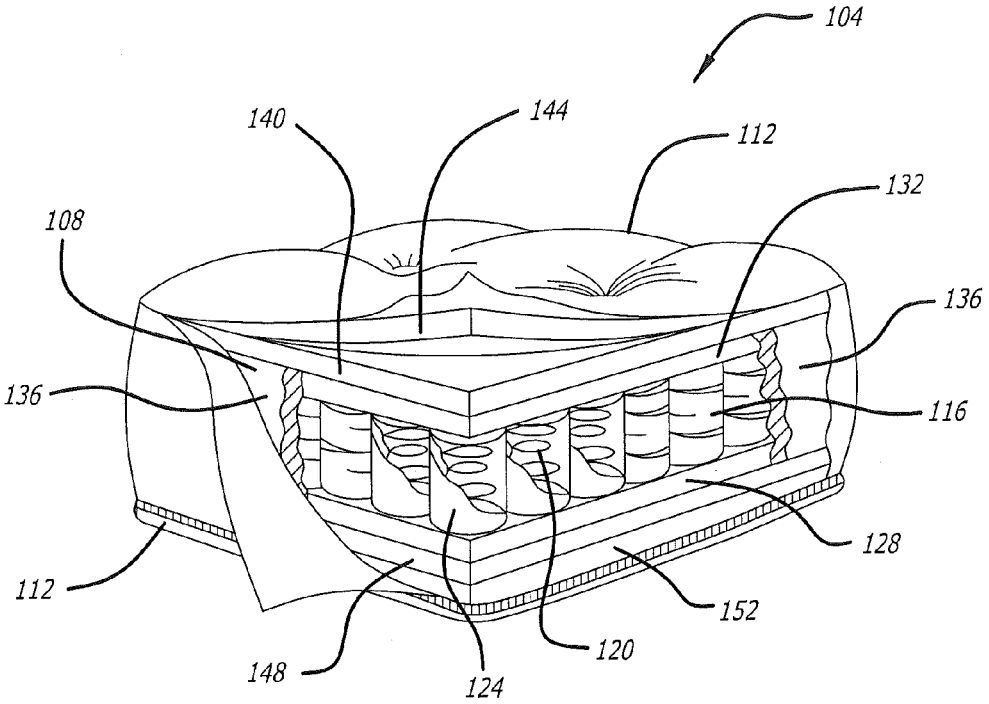
104
140
144
112
132
108
136
136
116
128
112
152
120
148
124

SOFA SEAT CUSHION CORE

PRIORITY

This application claims the benefit of, and priority to U.S. Provisional Application, entitled "Sofa Seat Cushion Core," filed on Feb. 13, 2015 having application Ser. No. 62/116,028, the entirety of said application is incorporated herein by reference.

FIELD

The field of the present disclosure generally relates to sofa seat cushions. More particularly, the field of the invention relates to an apparatus and a method for a durable sofa seat cushion which conforms to a person's body and maintains an original shape and performance more effectively than conventional sofa seat cushions.

BACKGROUND

A couch or sofa is a piece of furniture in the form of a bench, with or without armrests, suitable for seating two or more people. Sofas typically are upholstered and fitted with tailored seat cushions. Sofa seat cushions generally comprise a core which includes one or more "support layers" and upholstery comprising one or more "comfort layers." A conventional sofa seat cushion core typically comprises upholstery-grade polyurethane foam wrapped in polyethylene terephthalate (PET), known by the brand name "Dacron," all of which covered in decorative upholstery. The Dacron provides friction to maintain the visual appearance of the cushion.

A drawback to conventional sofa seat cushions, however, is a limited capacity for conforming to a person's body, and thus limited comfort. Another drawback to conventional sofa seat cushions is they have a limited durability, and thus conventional seat cushions tend to quickly lose their original shape. What is needed, therefore, is a sofa seat cushion which conforms to a person's body and maintains an original shape and performance more effectively than conventional sofa seat cushions.

SUMMARY

An apparatus and a method are provided for a sofa seat cushion comprising a cushion core including a multiplicity of pocketed springs enclosed within an upholstery foam envelope. The pocketed springs are positioned side by side in a spring layer arrangement and are independently operable. At least one memory foam layer positioned above the upholstery foam envelope comprises a material composition capable of molding to a person's body sitting on the sofa seat cushion and then quickly returning to an original shape once the person leaves the sofa seat cushion. In some embodiments, the memory foam layer comprises a gel-infused visco-elastic memory foam. A polyethylene terephthalate layer may be positioned above the memory foam layer. Directly below the upholstery foam envelope is an upholstery-grade polyurethane foam layer. At least one polyethylene terephthalate layer may be positioned directly below the upholstery-grade polyurethane foam layer. In some embodiments, one or more memory foam layers may be positioned between the upholstery foam envelope and the upholstery-grade polyurethane foam layer. An exterior upholstery is configured to surround the cushion core and provide a plush seating surface.

In an exemplary embodiment, a sofa seat cushion comprises a cushion core including a multiplicity of pocketed springs enclosed within an upholstery foam envelope, at least one memory foam layer positioned above the upholstery foam envelope, at least one polyethylene terephthalate ("Dacron") layer positioned above the at least one memory foam layer, an upholstery-grade polyurethane foam layer directly below the upholstery foam envelope, and at least one Dacron layer directly below the upholstery-grade polyurethane foam layer; and an exterior upholstery surrounding the cushion core.

In another exemplary embodiment, the multiplicity of pocketed springs are positioned side by side in a spring layer arrangement, the pocketed springs being independently operable. In another exemplary embodiment, each of the pocketed springs comprises a coil spring covered with a flexible wrap. In another exemplary embodiment, the flexible wrap comprises a fabric or textile material. In another exemplary embodiment, the coil springs are comprised of steel.

In another exemplary embodiment, the upholstery foam envelope comprises a bottom upholstery foam layer, a top upholstery foam layer, and a side upholstery foam layer. In another exemplary embodiment, the bottom upholstery foam layer is positioned directly beneath the multiplicity of pocketed springs, and wherein the top upholstery foam layer is directly above the pocketed springs. In another exemplary embodiment, the side upholstery foam layer borders a perimeter of the multiplicity of pocketed springs, the bottom upholstery foam layer, and the top upholstery foam layer. In another exemplary embodiment, the side upholstery foam layer comprises a single foam piece configured to extend around the perimeter of the multiplicity of pocketed springs. In another exemplary embodiment, the side upholstery foam layer comprises two or more foam pieces that are positioned end to end so as to border the perimeter of the multiplicity of pocketed springs.

In another exemplary embodiment, the memory foam layer comprises a material composition configured to contour a person's body in response to heat and pressure due to the person sitting on the sofa seat cushion, the memory foam layer being configured to quickly return to an original shape once the pressure and heat are removed from the sofa seat cushion. In another exemplary embodiment, at least a portion of the memory foam layer is comprised of a visco-elastic memory foam. In another exemplary embodiment, the at least a portion of the memory foam layer is comprised of a gel-infused visco-elastic memory foam.

In an exemplary embodiment, a method for a sofa seat cushion comprises arranging a multiplicity of pocketed springs into a spring layer arrangement; enclosing the spring layer within an upholstery envelope; positioning at least one memory foam layer above the upholstery envelope; extending at least one friction barrier between the at least one memory foam layer and an exterior upholstery; placing an upholstery-grade polyurethane foam layer directly below the upholstery foam envelope; and extending at least one friction barrier between the upholstery-grade polyurethane foam layer and the exterior upholstery.

In another exemplary embodiment, positioning comprises configuring a material composition of the memory foam layer capable of molding to a person's body in response to heat and pressure due to the person sitting on the sofa seat cushion, the material composition of the memory foam layer being configured to quickly return to an original shape once the pressure and heat are removed from the sofa seat cushion. In another exemplary embodiment, configuring comprises forming at least a portion of the memory foam layer of a visco-elastic memory foam. In another exemplary embodiment, configuring comprises forming at least a portion of the memory foam layer of a gel-infused visco-elastic memory foam. In another exemplary embodiment, extending at least one friction barrier comprises configuring at least one polyethylene terephthalate ("Dacron") layer to discourage migration of the exterior upholstery. In another exemplary embodiment, placing the upholstery-grade polyurethane foam layer further comprises positioning at least one memory foam layer between the upholstery foam envelope and the upholstery-grade polyurethane foam layer.

BRIEF DESCRIPTION OF THE DRAWINGS

The drawings refer to embodiments of the present disclosure in which:

FIG. 1 illustrates a cutaway view of an exemplary embodiment of a sofa seat cushion in accordance with the present disclosure.

While the present disclosure is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the invention disclosed herein may be practiced without these specific details. In other instances, specific numeric references such as "first cushion," may be made. However, the specific numeric reference should not be interpreted as a literal sequential order but rather interpreted that the "first cushion" is different than a "second cushion." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In general, the present disclosure describes an apparatus and a method for a sofa seat cushion comprising a cushion core surrounded by an exterior upholstery. The cushion core comprises a multiplicity of pocketed springs enclosed within an upholstery foam envelope. The pocketed springs are positioned side by side in a spring layer arrangement, such that the pocketed springs are independently operable. At least one memory foam layer is positioned above the upholstery foam envelope. The memory foam layer comprises a material composition capable of molding to a person's body in response to heat and pressure due to the person sitting on the sofa seat cushion and then quickly returning to an original shape once the pressure and heat are removed from the sofa seat cushion. In some embodiments, the memory foam layer comprises a gel-infused visco-elastic memory foam. At least one polyethylene terephthalate ("Dacron") layer may be positioned above the memory foam layer. Directly below the upholstery foam envelope may be one or more upholstery-grade polyurethane foam layers. At least one Dacron layer may be positioned directly below the upholstery-grade polyurethane foam layer. The Dacron layers are configured to provide a plush surface so as to enhance the tailoring of the upholstery surrounding the cushion core.

FIG. 1 illustrates a cutaway view of an exemplary embodiment of a sofa seat cushion 104 in accordance with the present disclosure. The sofa seat cushion 104 generally comprises a cushion core 108 and an exterior upholstery 112. As illustrated in FIG. 1, the cushion core 108 comprises a multiplicity of pocketed springs 116 placed side by side into a spring layer arrangement. Each of the pocketed springs 116 comprises a coil spring 120 covered with a flexible wrap 124, such as, by way of non-limiting example, a fabric or textile material. The coil springs 120 preferably are comprised of a metal such as steel. Those skilled in the art will recognize that the pocketed springs 116 are, in some respects, similar to Marshall coils utilized in mattresses.

In the illustrated embodiment of FIG. 1, the multiplicity of pocketed springs 116 is enclosed within an upholstery foam envelope. As such, the upholstery foam envelope comprises a bottom upholstery foam layer 128, a top upholstery foam layer 132, and a side upholstery foam layer 136. The bottom upholstery foam layer 128 is positioned directly beneath the multiplicity of pocketed springs 116, and the top upholstery foam layer 132 is directly above the pocketed springs 116. The side upholstery foam layer 136 borders the perimeter of the multiplicity of pocketed springs 116 as well as the bottom and top upholstery foam layers 128, 132. In some embodiments, the side upholstery foam layer 136 comprises a single foam piece that may be extended around the perimeter of the multiplicity of pocketed springs 116. Single foam pieces are particularly advantageous in some embodiments of the sofa seat cushion 104 that include rounded perimeter corners. In some embodiments, the side upholstery foam layer 136 may be comprised of two or more foam pieces that are positioned end to end so as to border the perimeter of the pocketed springs 116. As will be appreciated, multiple foam pieces may be advantageously utilized in embodiments of the sofa seat cushion 104 that comprise square or rectangular perimeter shapes, or otherwise include angled perimeter corners.

It should be understood that the multiplicity of pocketed springs 116 enclosed within the upholstery foam layers 128, 132, 136 operate to provide support and durability to the sofa seat cushion 104. Each of the coil springs 120 is individually enclosed within the flexible wrap 124, thereby allowing the pocketed spring 116 to operate independently of the other pocketed springs within the cushion core 108. As such, when a person sits on the sofa cushion seat 104, the pocketed springs 116 operate similarly to a plurality of automobile shock absorbers, compressing to various degrees so as to contour the person's body and comfortably support the person's weight. It will be appreciated that incorporating the coil springs 120 into the cushion core 108 provides a greater degree of durability to the sofa seat cushion 104 than is possible with solely foam-based cushion cores. Further, enclosing the multiplicity of pocketed springs 116 within the upholstery foam layers 128, 132, 136 provides lateral support to the coil springs 120, as well as providing a soft cushion layer on the top and bottom of the sofa seat cushion 104. Thus, the upholstery foam layers 128, 132, 136 may generally operate to maintain the shape of the seat cushion 104.

As shown in FIG. 1, the cushion core 108 comprises at least one memory foam layer 140 positioned above the top upholstery layer 132. The memory foam layer 140 preferably comprises a material composition capable of molding to the person's body in response to heat and pressure due to the person sitting on the sofa seat cushion 104. Once the person gets up from the sofa seat cushion 104, and thus the pressure is removed from the sofa seat cushion, the memory foam layer 140 returns to an original shape of the memory foam layer. In some embodiments, the memory foam layer 140 may be comprised of a visco-elastic memory foam. In some embodiments, the memory foam layer 140 may comprise a conforming visco-elastic foam coupled with a firmer polyurethane base foam layer. In some embodiments, the memory foam layer 140 may comprise a conforming visco-elastic foam coupled with latex so as to provide a desired benefit to the person sitting on the sofa seat cushion 104, such as by way of non-limiting example, relieving pressure on painful joints of the person, encouraging muscle relaxation, and the like.

In some embodiments, the memory foam layer 140 may be comprised of a gel-infused visco-elastic memory foam. As will be appreciated by those skilled in the art, when the person sitting on the sofa seat cushion 104 moves or changes position, the gel-infused visco-elastic memory foam will return to the original shape much more quickly than is possible with other materials. Further, the memory foam layer 140 comprising gel-infused visco-elastic memory foam conforms to the person's body better than does conventional polyurethane foam, as well as providing relatively greater body heat absorption and distribution. Thus, it should be recognized that coupling the foam-enclosed pocketed springs 116 with the memory foam layer 140 comprising gel-infused visco-elastic memory foam creates a unique, supportive, and comfortable seating surface not found in conventional sofa seat cushions.

As shown in the embodiment illustrated in FIG. 1, directly above the memory foam layer 140 may be at least one polyethylene terephthalate ("Dacron") layer 144 positioned underneath the exterior upholstery 112. As further shown, directly below the bottom upholstery layer 128 may be one or more upholstery-grade polyurethane foam layers 148. Directly below the upholstery-grade polyurethane foam layer 148 is at least one Dacron layer 152 substantially similar to the Dacron layer 144. It will be appreciated that the Dacron layers 144, 152 are configured to enhance the tailoring of the exterior upholstery 112 surrounding the cushion core 108, and thereby provide a plush seating surface. It will be further appreciated that the Dacron layers 144, 152 operate as friction barriers between the exterior upholstery 112 and the various foam layers within the seat cushion 104, thereby discouraging migration of the exterior upholstery 112 around the various foam layers within the cushion.

In some embodiments, a bottom memory foam layer may be positioned directly below the bottom upholstery layer 128. As with the memory foam layer 140, the bottom memory foam layer may be comprised of a gel-infused visco-elastic memory foam. As will be appreciated, when the person sits on the sofa seat cushion 104, in absence of the bottom memory foam layer, the person's body weight generally causes a bowing of the portion of the cushion 104 underneath the person. With the bottom memory foam layer present, however, the cushion 104 conforms to the person's body, as well as conforming to supportive structures under the cushion 104. Thus, the bottom memory foam layer operates to preserve the original shape of the cushion 104. In some embodiments, one or more layers of Dacron may be positioned directly below the bottom memory foam layer so as to enable an occasional flipping over of the seat cushion 104 so as to promote greater longevity of the cushion. It should be appreciated, therefore, that the bottom memory foam layer further contributes to a supportive, stable, and comfortable seating surface not found in conventional sofa seat cushions, as well as improving the longevity of the seat cushion.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

What is claimed is:

1. A sofa seat cushion, comprising:

a cushion core comprising a multiplicity of pocketed springs enclosed within an upholstery foam envelope, at least one memory foam layer positioned above the upholstery foam envelope, at least one polyethylene terephthalate layer positioned above the at least one memory foam layer, an upholstery-grade polyurethane foam layer directly below the upholstery foam envelope, and at least one polyethylene terephthalate layer directly below the upholstery-grade polyurethane foam layer; and an exterior upholstery surrounding the cushion core.

2. The sofa seat cushion of claim 1, wherein the multiplicity of pocketed springs are positioned side by side in a spring layer arrangement, the pocketed springs being independently operable.

3. The sofa seat cushion of claim 1, wherein each of the pocketed springs comprises a coil spring covered with a flexible wrap.

4. The sofa seat cushion of claim 3, wherein the flexible wrap comprises a fabric or textile material.

5. The sofa seat cushion of claim 3, wherein the coil springs are comprised of steel.

6. The sofa seat cushion of claim 1, wherein the upholstery foam envelope comprises a bottom upholstery foam layer, a top upholstery foam layer, and a side upholstery foam layer.

7. The sofa seat cushion of claim 6, wherein the bottom upholstery foam layer is positioned directly beneath the multiplicity of pocketed springs, and wherein the top upholstery foam layer is directly above the pocketed springs.

8. The sofa seat cushion of claim 7, wherein the side upholstery foam layer borders a perimeter of the multiplicity of pocketed springs, the bottom upholstery foam layer, and the top upholstery foam layer.

9. The sofa seat cushion of claim 8, wherein the side upholstery foam layer comprises a single foam piece configured to extend around the perimeter of the multiplicity of pocketed springs.

10. The sofa seat cushion of claim 8, wherein the side upholstery foam layer comprises two or more foam pieces that are positioned end to end so as to border the perimeter of the multiplicity of pocketed springs.

11. The sofa seat cushion of claim 1, wherein the memory foam layer comprises a material composition configured to contour a person's body in response to heat and pressure due to the person sitting on the sofa seat cushion, the memory foam layer being configured to quickly return to an original shape once the pressure and heat are removed from the sofa seat cushion.

12. The sofa seat cushion of claim 11, wherein at least a portion of the memory foam layer is comprised of a visco-elastic memory foam.

13. The sofa seat cushion of claim 12, wherein the at least a portion of the memory foam layer is comprised of a gel-infused visco-elastic memory foam.

14. A method for a sofa seat cushion, comprising:

arranging a multiplicity of pocketed springs into a spring layer arrangement;

enclosing the spring layer within an upholstery envelope;

positioning at least one memory foam layer within the upholstery envelope;

extending at least one friction barrier between the at least one memory foam layer and an exterior upholstery;

placing an upholstery-grade polyurethane foam layer directly beneath the upholstery foam envelope; and extending at least one friction barrier between the upholstery-grade polyurethane foam layer and the exterior upholstery.

15. The method of claim 14, wherein positioning comprises configuring a material composition of the memory foam layer capable of molding to a person's body in response to heat and pressure due to the person sitting on the sofa seat cushion, the material composition of the memory foam layer being configured to quickly return to an original shape once the pressure and heat are removed from the sofa seat cushion.

16. The method of claim 15, wherein configuring comprises forming at least a portion of the memory foam layer of a visco-elastic memory foam.

17. The method of claim 15, wherein configuring comprises forming at least a portion of the memory foam layer of a gel-infused visco-elastic memory foam.

18. The method of claim 14, wherein extending at least one friction barrier comprises configuring at least one polyethylene terephthalate layer to discourage migration of the exterior upholstery.

19. The method of claim 14, wherein placing the upholstery-grade polyurethane foam layer further comprises positioning at least one memory foam layer between the upholstery foam envelope and the upholstery-grade polyurethane foam layer.

* * * * *